United States Patent [19]

Taylor et al.

[11] Patent Number: 4,735,034

[45] Date of Patent: Apr. 5, 1988

[54] TAG BANDING APPARATUS

[75] Inventors: Bruce E. Taylor, Tipp City; Orville C. Huggins, Dayton, both of Ohio; Augustus W. Griswold, Rush, N.Y.

[73] Assignee: Monarch Marking Systems, Inc., Dayton, Ohio

[21] Appl. No.: 91,287

[22] Filed: Aug. 24, 1987

Related U.S. Application Data

[63] Continuation of Ser. No. 817,329, Jan. 9, 1986, abandoned.

[51] Int. Cl.[4] ..... B65B 35/50

[52] U.S. Cl. ..... 53/540; 53/542; 53/586; 414/107; 414/108

[58] Field of Search ..... 53/540, 542, 586; 271/181; 414/71, 106, 107, 108

[56] References Cited

U.S. PATENT DOCUMENTS

| | | | |
|---|---|---|---|
| 1,263,515 | 4/1918 | Biehzer | 414/107 X |
| 1,464,306 | 8/1923 | Augustine | 414/107 |
| 2,154,757 | 4/1939 | Labombarde | 414/108 X |
| 2,941,676 | 6/1960 | Harker | 414/107 |
| 3,119,213 | 1/1964 | Kinney | 53/540 X |
| 3,182,821 | 5/1965 | Parker | 414/106 |
| 3,618,790 | 11/1971 | Carmody | 414/71 X |
| 3,682,329 | 8/1972 | Dean | 414/107 |
| 3,691,915 | 9/1972 | Kiela | 414/106 X |
| 3,901,392 | 8/1975 | Streckert | 414/71 |
| 4,419,035 | 12/1983 | Stobb | 414/71 |

FOREIGN PATENT DOCUMENTS

| | | | |
|---|---|---|---|
| 1244047 | 7/1967 | Fed. Rep. of Germany | 271/181 |

*Primary Examiner*—John Sipos

*Attorney, Agent, or Firm*—Joseph J. Grass

[57] ABSTRACT

There is disclosed an improved tag banding apparatus which conveys a tag to a stop position, positions tags one-by-one and accumulates the tags in a stack, and bands the stacks in a connected series.

15 Claims, 7 Drawing Sheets

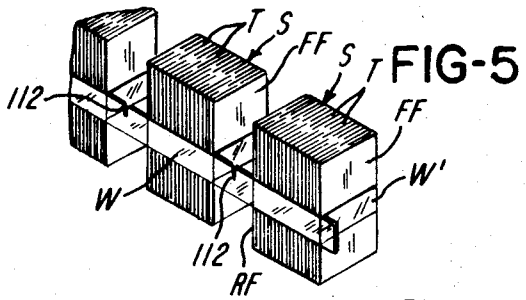
FIG-5
W'
FF
T
S
FF
S
T
112
RF
W
112
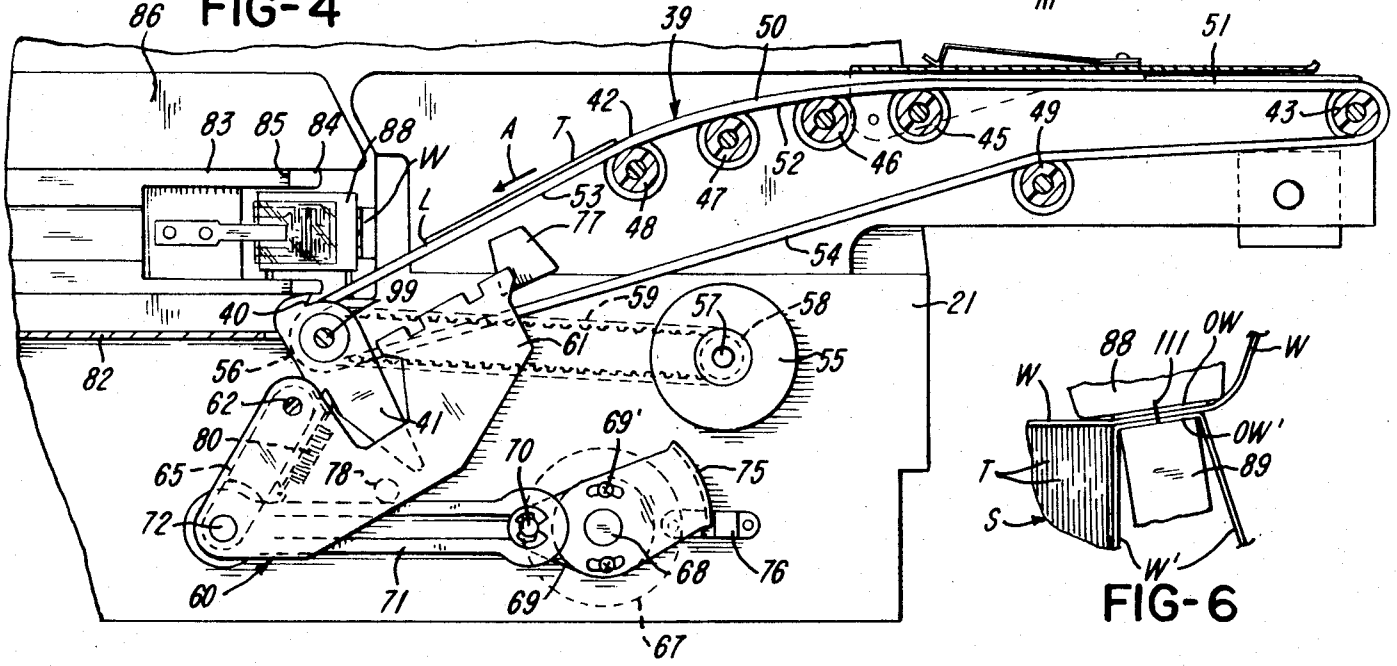
FIG-4
FIG-6
W
OW
OW'
89
111
88
W'
W
T
S

TAG BANDING APPARATUS

This application is a continuation of application Ser. No. 817,329, filed Jan. 9, 1986 now abandoned.

BACKGROUND OF THE INVENTION

1. Field of the Invention

This invention relates to the art of tag banding apparatus.

2. Brief Description of the Prior Art

The following are made of record: U.S. Pat. Nos. 3,580,786, 4,617,784, British patent specifications Nos. 626,755 accepted July 20, 1949 and 1,316,916 published May 16, 1973 and British patent application No. 2,152,465A.

SUMMARY OF THE INVENTION

This invention relates to low-cost, simple, and improved tag banding apparatus.

It is a feature of the invention to provide a tag banding apparatus wherein a conveyor brings tags one-by-one to a stop position provided by a movable stop member, a tamper orients the tags and positions them in a stack, the tags are stripped from the stop member as they are oriented, and a complete stack is banded.

It is another feature of the invention to provide a simple improved drive for a movable jaw and a knife, wherein the drive includes a reversible electric motor and a worm driven by the motor to effect movement of the jaw toward and away from a cooperating jaw to effect heat sealing of overlapped web portions. Another respect of the invention is that the knife can be driven to either partially sever banding material between adjacent stacks so that the stacks remain detachable connected, or the last stack can be severed from webs of handing material.

It is another feature of the invention to provide a tag banding apparatus with a heat sealing device comprised of a printed circuit member in which its prined resistive heating elements are of low mass and can heat and cool quickly. This prevents overheating of the web and allows better control of the heat sealing process.

It is another feature of the invention to provide a tag banding apparatus in which a pair of jaws is used to heat seal overlapped web portions of a pair of webs of banding material, wherein one of the jaws is mounted for movement at an acute angle relatively toward the rear face of a tag stack and toward another jaw while drawing one of the webs from its roll.

It is another feature of the invention to provide a low-cost, simple, reliable tag banding apparatus including a conveyor driven by one electric motor for bringing tags one-by-one to a stop position, a tag transferring device driven by another electric motor, and band web sealing means driven by yet another electric motor. The use of separate motors makes possible the production of a tag banding apparatus having relatively few parts.

It is another feature of the invention to provide a tag banding apparatus with a curved, channel-shaped discharge chute which enables a large number of banded tag stacks to be accumulated within a small area.

DESCRIPTION OF THE DRAWINGS

FIG. 4 is an enlarged sectional view taken generally along line 4—4 of FIG. 2;

FIG. 5 is a perspective view showing a series of connected stacks of tags;

FIG. 6 is a fragmentary diagrammatic view showing the manner in which the heat sealing jaws cooperate with overlapped portions of the webs of banding material;

DETAILED DESCRIPTION OF THE PREFERRED EMBODIMENT

Figure 1:
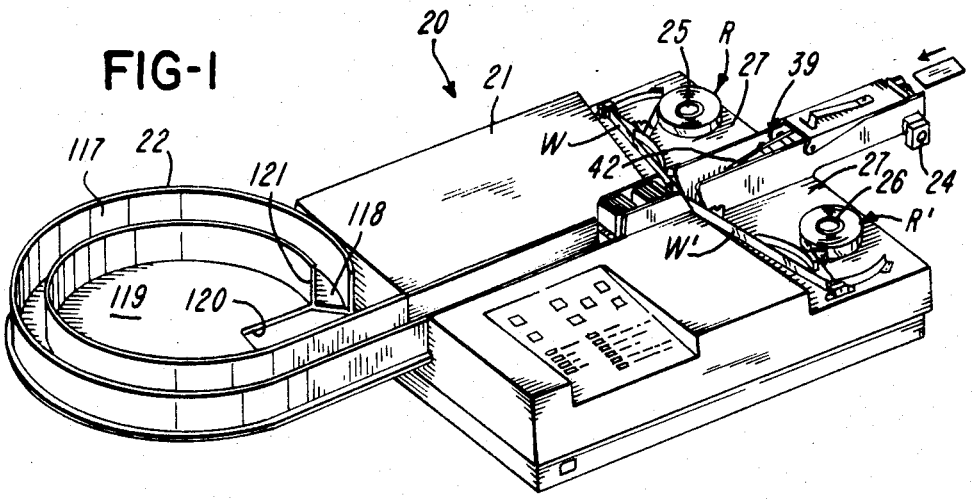
FIG. 1 is a perspective view of a tag banding apparatus in accordance with the invention.
Figure 2:
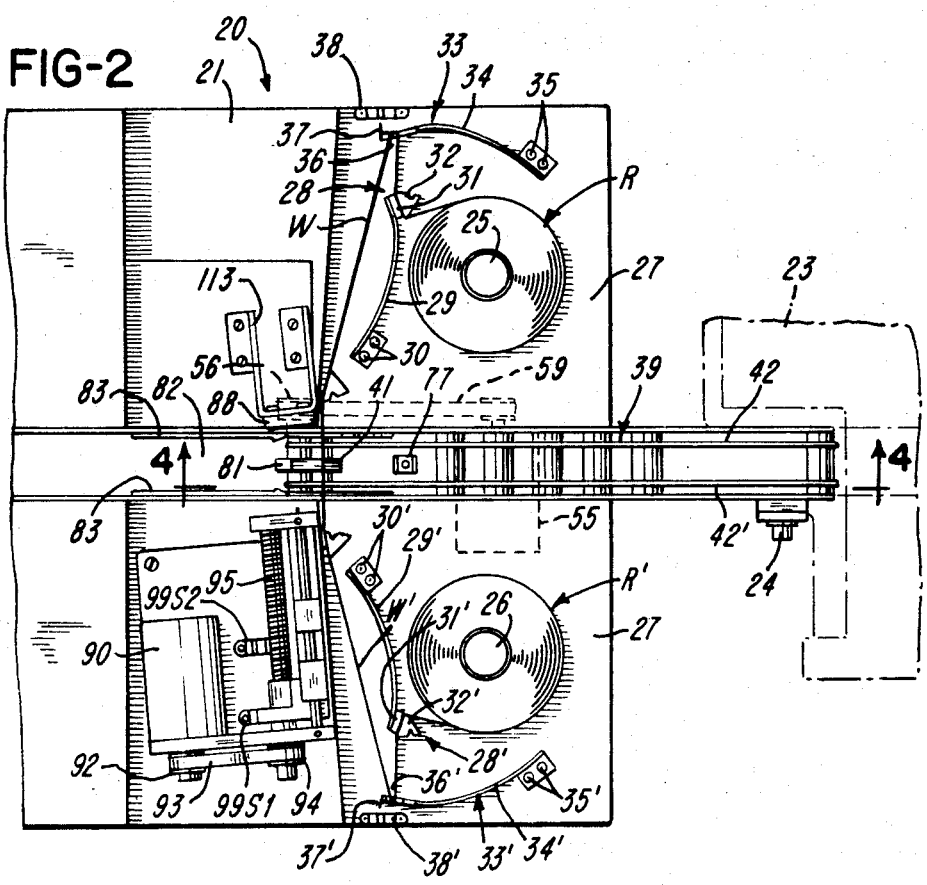
FIG. 2 is a top plan view of a fragmentary portion of the tag banding apparatus shown connected to a printer.

With reference to FIGS. 1 and 2, there is shown a tag banding apparatus generally indicated at 20. The apparatus 20 is shown to include a housing or frame 21 to which a discharge chute 22 is connected. The apparatus 20 is removably connected to a printer 23, shown in phantom lines in FIG. 2, by a fastener 24. The apparatus 20 has a pair of parallel shafts or spindles 25 and 26 for rotatably mounting rolls R and R′ of webs W and W′ of commercially available heat sealable banding material. The rolls R and R′ are supported on coplanar surfaces 27 of the housing 21. The webs W and W′ extend between brakes 28 and 28′ comprised of flexible resilient leaf springs 29 and 29′ secured to the surfaces 27 by fasteners 30 and 30′, felt pads 31 and 31′ on the springs 29 and 29′, and stationary back-up members 32 and 32′. The webs W and W′ are lightly pinched between respective pairs of pads and back-up members 31 and 32, and 31′ and 32′. From the brakes 28 and 28′ the webs W and W′ pass to respective resilient devices 33 and 33′. The resilient devices 33 and 33′ are comprised of leaf springs 34 and 34′ secured to the surfaces 27 by fasteners 35 and 35′. The springs 34 and 34′ mount pins 36 and 36′ about which the webs W and W′ pass at a sharp angle. The webs W and W′ are under tension beyond the brakes 28 and 28′. The springs 34 and 34′ carry vanes 37 and 37′ which cooperate with switches 38 and 38′ when there is inadequate tension in the webs W and W′. When either vane 37 and 37′ cooperates with respective switch 38 or 38′ the apparatus is turned off. The loss of tension can result for example if the roll R or R′ is exhausted or if the web W or W′ should break.

Figure 3:
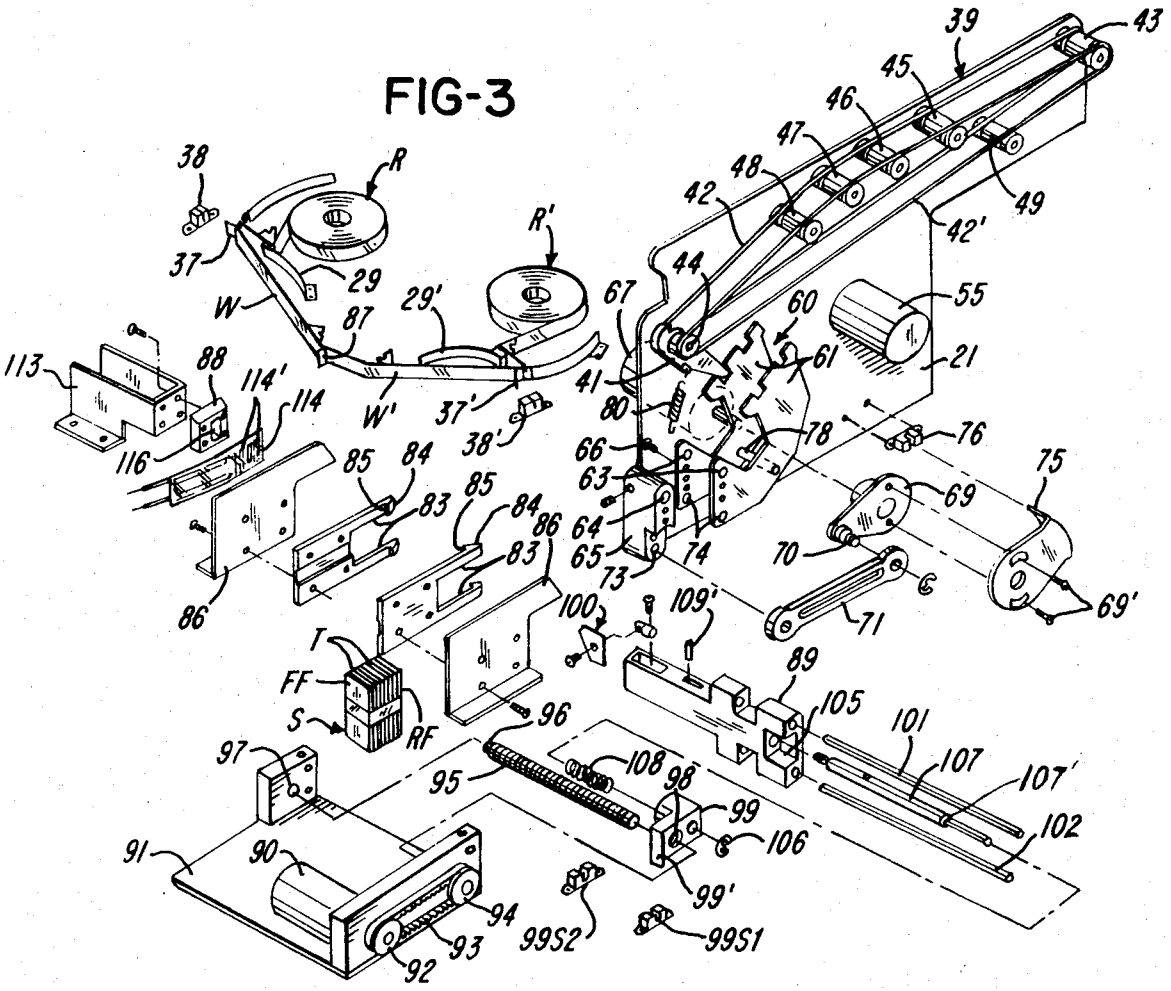
FIG. 3 is an exploded perspective view of certain components of the tag banding apparatus.

With reference to FIGS. 2, 3 and 4, there is shown a conveyor generally indicated at 39 for conveying tags T one-by-one from the printer 23 to a stop position in a notch 40 of a stop member 41. The conveyor 39 is shown to include a spaced pair of round elastomeric belts 42 and 42' passing about pulleys 43 and 44 and over grooved rollers 45 through 49. The rollers 45, 46, 47 and 48 are disposed along a slight arc so that the upper pass 50 of belts 42 and 42' takes the tags T from a generally horizontal portion 51 through a curved portion 52 to a downwardly inclined portion 53. The lower pass 54 extends upwardly from the pulley 44. The notch 40 is aligned with the upper surface of the portion 53 of the belts 42 and 42' so that the leading end L of each tag T reliably comes to rest in the notch 40. The notch 40 is shown to be generally V-shaped.

The pulley 44 is continuously driven by an electric motor 55 during operation of the printer 23. A pulley 56 is secured to the pulley 44, and a pulley 58 is secured to motor shaft 57. A pulley belt 59 is trained about pulleys 56 and 58 to cause the belts 42 and 42' to be driven continuously in the direction of arrow A.

Figure 7:
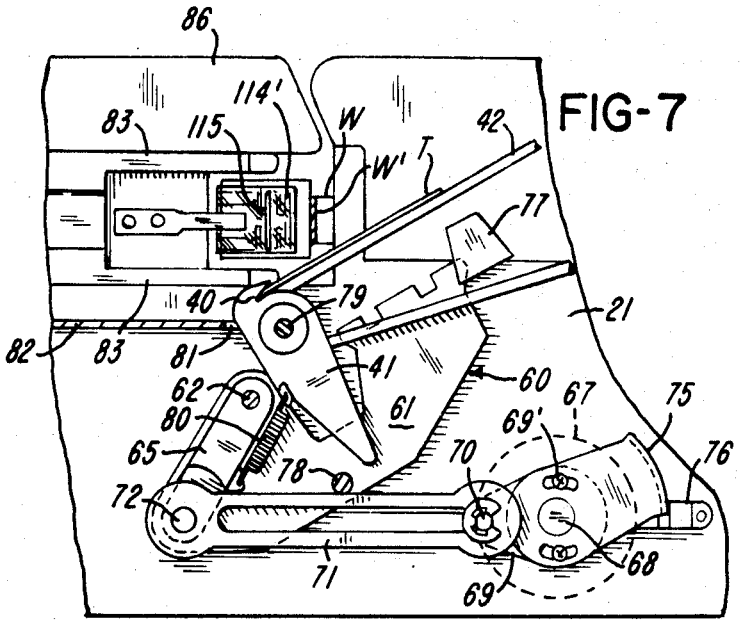
FIG. 7 is an elevational view showing how a leading edge of a tag is located in a notch of a stop member.
Figure 8:
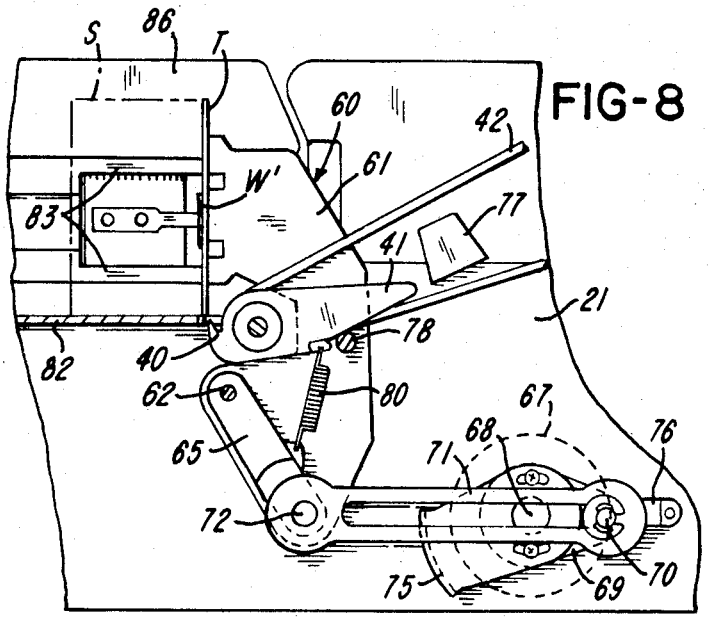
FIG. 8 is a view similar to FIG. 7 but showing the stop member and a tamper or pusher as having moved a tag from an inclined position to an upright position.

A tag T which has been fed to the position shown in FIG. 7 is transferred to the position shown in FIG. 8 by a transferring or pusher device or tamper generally indicated at 60. The tamper 60 is shown to be comprised of spaced members 61 pivotally mounted as a unit about a pin 62. The pin 62 passes through holes 63 in the members 61 and through a hole 64 in a bracket 65. The bracket 65 and members 61 pivot as a unit about the pin 62. One of the members 61 is secured by fasteners 66 to the bracket 65. An electric motor 67 has a shaft 68 to which a crank 69 is secured. The crank 69 has a pin 70 pivotally connected to one end portion of a connecting rod 71. A pin 72 received in hole 73 in the bracket 65 and in holes 74 in members 61 is pivotally connected to the other end portion of the connecting rod 71. A vane 75, adjustably connected to the crank 69 by screws 69', cooperates with a switch 76.

A tag T passing along the upper pass 50 of the conveyor 39 is sensed by an optical sensor 77. After a time delay sufficient to enable the leading end L of the tag T to be positioned in the notch 40, the motor 67 is operated through one complete revolution of the shaft 68. Clockwise rotation of the shaft 68 (FIG. 7) causes the tamper 60 to pivot counterclockwise from the position shown in FIG. 7 to the position shown in FIG. 8. The stop member 41 is positioned between the tamper members 61. A pin 78 connected to the members 61 is shown spaced from the stop member 41. As the tamper 60 pivots clockwise, the pin 78 contacts the stop member 41 and upon continued pivoting of the tamper 60, the pin 78 drives the stop member 41 counterclockwise about pivot 79 from the FIG. 7 position to the FIG. 8 position. The stop member 41 is normally biased clockwise by a tension spring 80 connected to the bracket 65 and to the stop member 41. The stop member 41 pivots through a slot 81 in a shelf 82 which acts as a stripper. As the stop member 41 passes into the FIG. 8 position, the shelf 82 strips the tag T from the notch 40. By this time, the tamper 60 has transferred or pushed the tag T to the upright or vertical orientation. The stop member 41 supports the tag T as the tamper 60 pushes the tag T to its vertical orientation so that the tag movement is totally controlled. Upon continued rotation of the motor shaft 68, the tamper 60 and the stop member 41 are returned to their original positions, whereupon the vane 75 operates the switch 76 to stop the motor 67.

As the tags T outputted from the printer 23 pass one-by-one onto the conveyor 39, the sensor 77 senses each successive tag T and this causes the motor shaft 68 to make one complete revolution following a short delay. As tags T are transferred one-by-one by the tamper 60, the stack S created thereby increases until the predetermined tag count is reached.

Each time the tamper 60 operates, it causes the just transferred tag T to deflect spring fingers 83 outwardly. The spring fingers 83 have cam faces 84 which terminate at hooks 85. Each tag T contacts the cam faces 84 and urges the spring fingers 83 outwardly. When each tag T clears the hooks 85, the spring fingers 83 return to their initial positions and the hooks 85 prevent retrograde movement of the last or rear tag. The spring fingers 83 are secured to frame-mounted brackets 86.

FIG. 3 shows the webs W and W' with their free ends overlapped and sealed as indicated at 87. As tags T continue to be stacked on the shelf 82, the webs W and W' are drawn off respective rolls R and R'. The front face FF of the stack S bears against the web W'. The web W extends along side edge of the stack S, and the web W' extends along the other side edge of the stack S. There is a cooperating pair of jaws 88 and 89 which can heat seal overlapped portions OW and OW' of the respective webs W and W'. A series or band of banded stacks S is shown in FIG. 5.

With reference to FIG. 3, an electric motor 90 mounted on a U-shaped bracket 91 drives a pulley 92. A belt 93 driven by pulley 92 drives a pulley 94. The pulley 94 drives a worm 95. An end portion 96 of the worm 95 is journalled in a hole 97 in the bracket 91. The worm 95 is received in a threaded bore 98 in a block 99. The block 99 drives the jaw 89 and a knife generally indicated at 100.

Figures 9, 10, 11, 12, 13:
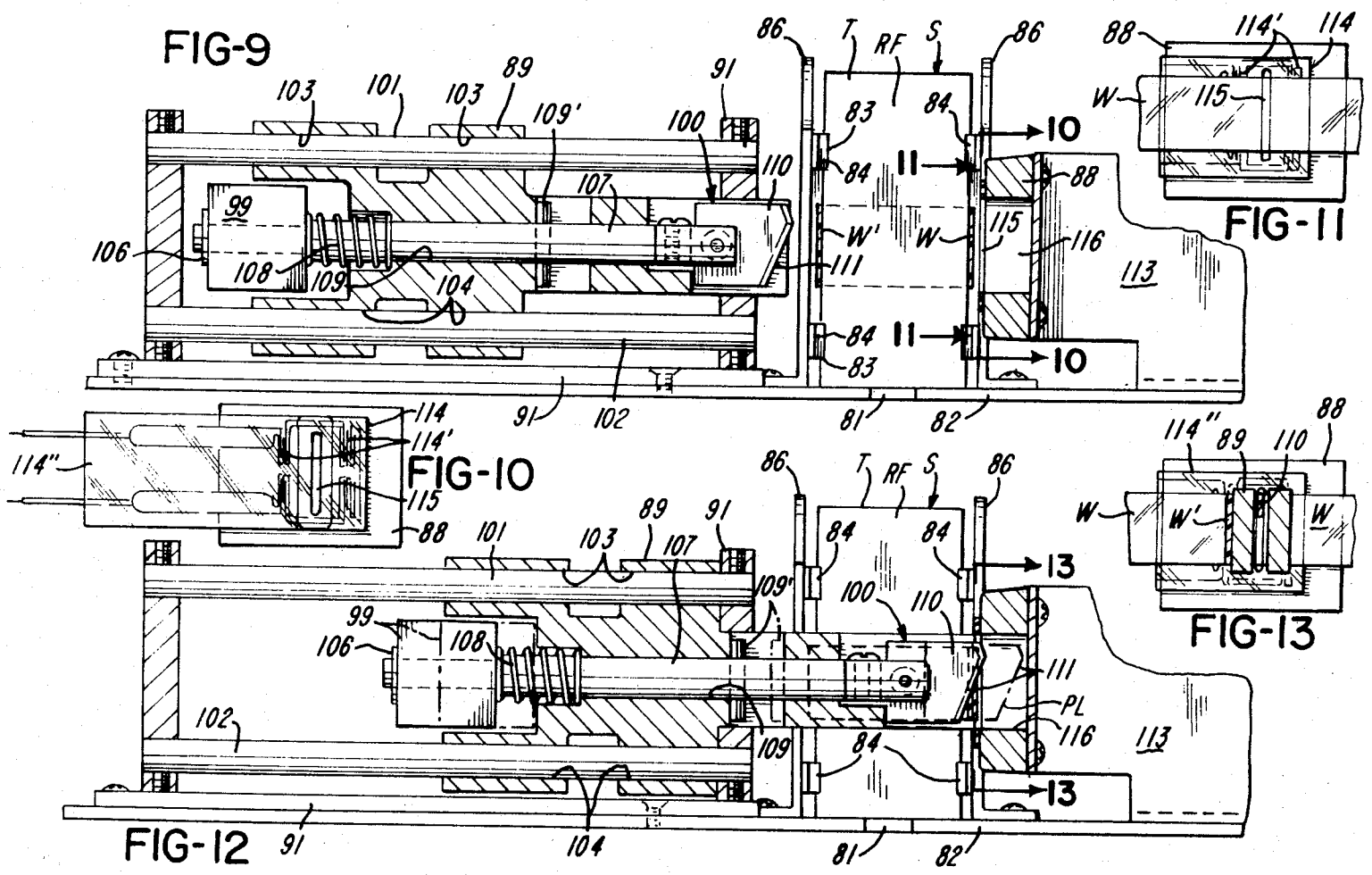
FIG. 9 is an enlarged partly sectional view of the jaws and a knife in their initial positions.
FIG. 10 is a view taken generally along line 10—10 of FIG. 9.
FIG. 11 is a sectional view taken generally along line 11—11 of FIG. 9.
FIG. 12 is a view similar to FIG. 9 but showing one jaw in cooperation with another jaw and showing the knife in both solid line and phantom line positions.
FIG. 13 is a sectional view taken along line 13—13 of FIG. 12.

With reference also to FIG. 9, a pair of guide rods 101 and 102 slidably mount the jaw 89. The rods 101 and 102 pass through respective bores 103 and 104 in the jaw 89. The block 99 is received in a cutout 105 in the jaw 89. The block 99 is received between an E-ring 106 and a step 107' in a shaft 107. A compression spring 108 encircles the shaft 107. The shaft 107 passes through a bore 109 in the jaw 89. A pin 109' passes through the shaft 107 and helps maintain the spring 108 under slight preloading. As the electric motor 90 operates, the worm 95 is rotated to advance the block 99. As the block 99 advances, the block 99 pushes against the spring 108 and the jaw 89 moves to the right as viewed in FIG. 9 to the solid line position shown in FIG. 12. The knife 100 includes a replaceable blade 110 having an inclined face 111. In the FIG. 12 position, the knife blade 110 nicks or partially severs the webs W and W' at the overlapped portions OW and OW' to provide nicks or partial severing as shown at 112 in FIG. 5. When it is desired to sever the overlapped web portions OW and OW' completely, the motor 90 continues to drive the worm 95 and the spring 108 is thereby further compressed to move the knife 100 to the position shown by phantom lines PL in FIG. 12.

When the jaw 89 reaches the position shown in FIG. 12, the jaws 88 and 89 cooperate to seal the overlapped web portions OW and OW'. The jaw 88 is secured to a frame-mounted bracket 113. Secured to the front face of the jaw 88 is a printed circuit member 114 with printed resistive heating elements or a heater 114' on a non-electrically conductive substrate 114''. The circuit member 114 has a slot 115 aligned with a recess 116 in the jaw 88 to allow for entry of the knife blade 110. The resistive heating elements 114' are of very low mass and thus heat and cool rapidly. By way of example, not limitation, the heating elements 114' are comprised of printed nickel iron material about 0.0005 inch thick on a 0.002 inch substrate 114". When the sealing and partial severing or complete severing of the overlapped web portions OW and OW' is complete, the electric motor 90 is reversed and thus the worm 95 is rotated in the opposite direction to return the jaw 89 and the knife 100 to the FIG. 9 position. When the jaw 89 has returned to the FIG. 9 position, the apparatus 20 is ready to start accumulating another stack S of tags T. The block 99 has a vane 99' which cooperates with switches 99S1 and 99S2.

As shown in FIGS. 2 and 6, the jaw 89 is inclined at an acute angle with respect to the rear face RF of the stack. This enables the web W' to be drawn from the roll R' more readily. It also prevents the jaw 89 from contacting the edge of the tag T that provides the rear face RF. As shown, the jaw 88 is also inclined so that the jaws 88 and 89 cooperate face-to-face.

As shown in FIG. 1, the discharge chute 22 provides a channel 117 into which the banded stacks S of tags T are pushed by the tamper 60. The chute 22 is curved to provide a long path for the tag stacks S without the need for a large table. The chute 22 is curved through more than 180°, and preferably to 270°. The chute 22 has a floor 118 coplanar with a floor 119. The floor 119 has a discharge opening 120 adjacent open discharge end 121 of the chute 22. The band of stacks S can descend through the opening 120 and collect on the supporting table (not shown) or in any suitable receptacle.

Figure 14:
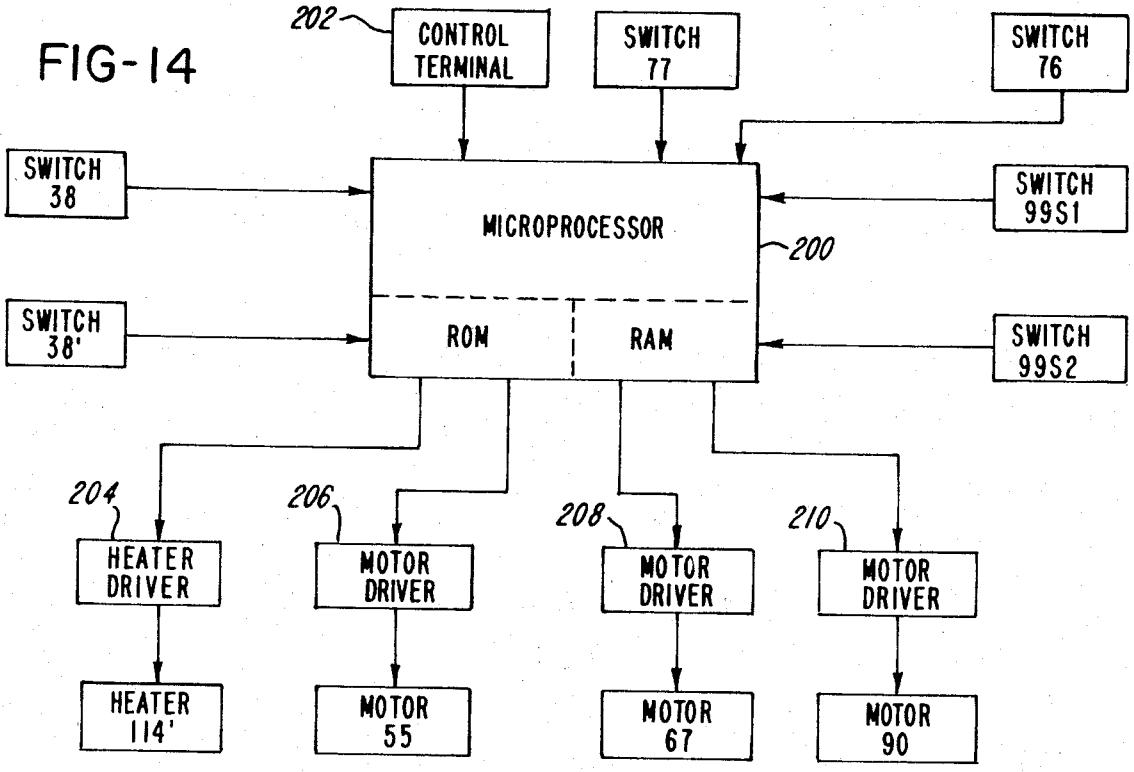
FIG. 14 is a block diagram of the controls for the tag banding apparatus.

Referring to FIG. 14, a microprocessor 200, which may be any suitable commercially available microprocessor such as, for example, a Motorola MC6805 microprocessor or other suitable microprocessor controls the sequence of operation of the banding apparatus according to the invention. The microprocessor 200 may have all of the necessary random access (RAM) and read only (ROM) memory contained therein as shown in FIG. 14, or may use external memories instead of or in addition to the ROM and the RAM illustrated in FIG. 14.

The number of tags T in each stack S and the number of stacks S produced before the band of stacks is completely cut is entered by a control terminal 202 which may include a keyboard or an interface for communication with a remotely based computer or terminal. When a keyboard is used, the operator manually enters the desired number of tags in each stack, for example, ten for the first stack, one hundred for the second stack, etc. The number of stack defining entries can be counted to determine the number of stacks to be banded before the band of tags T is completely severed, or the number of stacks S can be manually entered. The number of tags T per stack can be the same or different for each stack. The data defining the number of stacks and the number of tags per stack is stored in the memory of the microprocessor 200.

Other inputs to the microprocessor 200 include switches 38 and 38' which sense the tension of the webs W and W', respectively, and terminate the operation of the banding apparatus 20 in the event of an out-of-tape or low tension condition. Other inputs to the microprocessor 200 include the switch 77 which senses the presence of a tag in the conveyor 39, the switch 99S1, which is the home position sensor for the jaw 89, and the switch 99S2, which is the nick position sensor for the jaw 89. These switches sense the position of a tag T and the sealing jaw position and cooperate with the microprocessor 200 to control the operation of the heater 114', the conveyor motor 55, the tamper motor 67 and the jaw drive motor 90 via a heater driver 204 and motor drivers 206, 208 and 210, respectively. The drivers are responsive to signals applied thereto from the microprocessor 200 and serve to drive the respective heater or motor upon command from the microprocessor 200. The conveyor motor 55 is driven by the motor driver 206 as long as the banding apparatus is in operation, and the jaw heater 114', the tamper motor 67 and the jaw motor 90 are driven intermittently during the operation of the banding apparatus as will be discussed in conjunction with FIG. 15.

Figure 15:
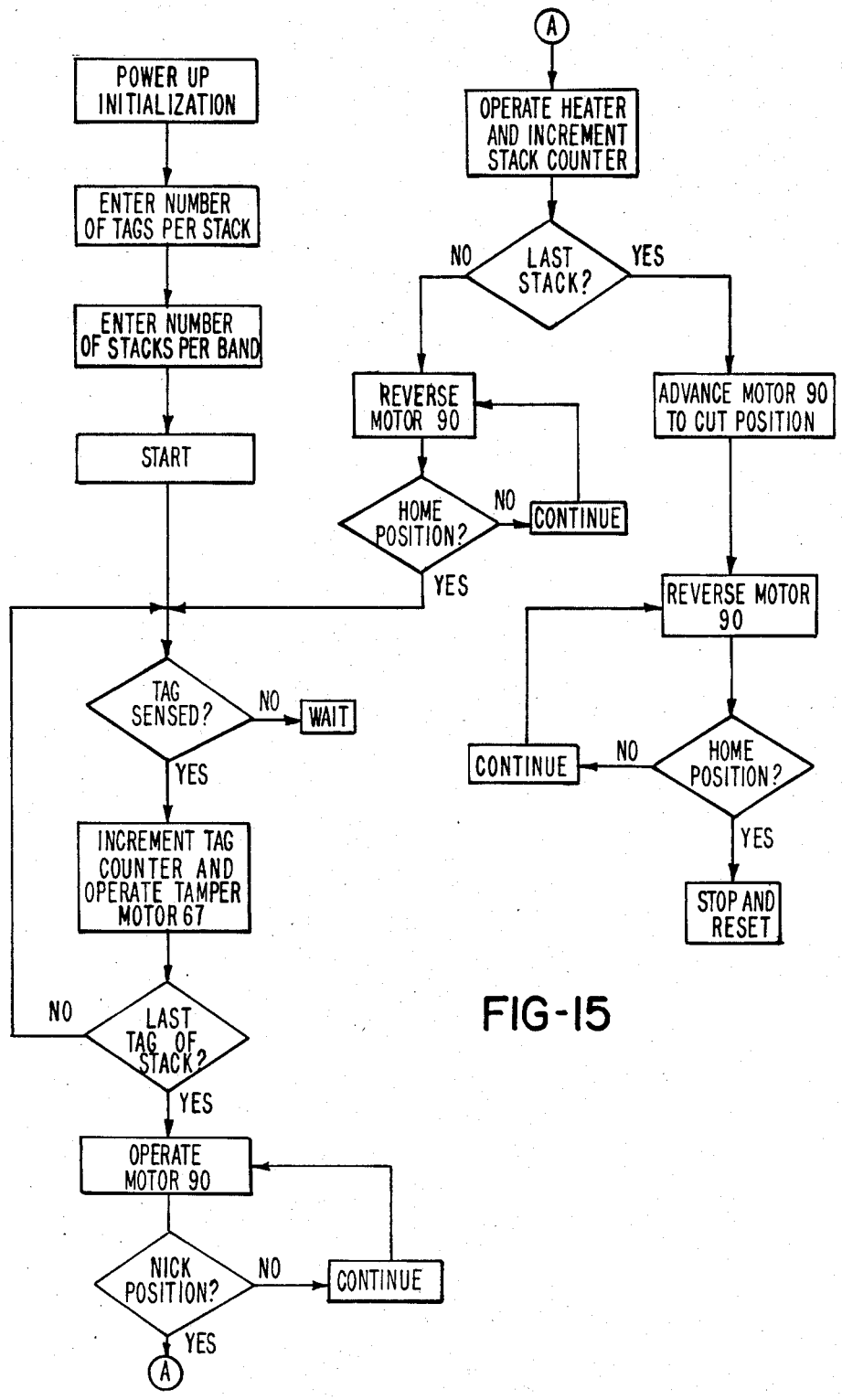
FIG. 15 is a functional logic diagram illustrating the operation of the control logic for the banding apparatus.

Referring now to FIG. 15, all circuits are initialized and counters are set to zero during a power up initialization that occurs when power is first applied to the banding apparatus. After power up initialization, the apparatus 20 is ready to accept data defining the number of tags per stack and the number of stacks S between cuts. This data may be entered via the keyboard or otherwise, as previously discussed. After the entry of the data defining the number of tags per stack and the number of stacks per band or series, a start command initiates the operation of the banding sequence. The start command may be manually entered via the keyboard or may be a remotely generated command.

After the start command is entered, the switch 77 (FIG. 14) is monitored to determine whether a tag T is present. As long as no tag T is sensed, operation is suspended.

Once a tag T is sensed, a tag counting counter is incremented and the tamper 60 is operated for one complete cycle to tamp a tag T into the stack as previously discussed. The tag counter is then read to determine whether the last sensed tag is the last tag of the stack. This may be accomplished in a variety of ways, for example, by presetting the counter with the desired number of tags T in the stack S, decrementing the counter each time a tag is sensed, and indicating a last tag condition when the counter is decremented to zero. Alternatively, this may be accomplished by setting a counter to zero, incrementing the count each time a tag is sensed, comparing the number of tags desired with the count in the counter and indicating a last tag condition when the count in the counter is equal to the number of tags desired.

As long as the last tag sensed is not the last tag of the stack, the switch 77 will be monitored for the presence of a tag on the conveyor, and the incrementing of the counter and tamper motor operation will be repeated each time a new tag is sensed until the last tag is sensed. After the last tag has been sensed, the jaw motor 90 will be operated, and will continue to be operated until the nick or partial sever position is sensed. The nick position is sensed by monitoring the nick position switch 99S2 until the presence of the vane 99' is sensed. Once the vane 99' is sensed by the switch 99S2, the heater 114' is operated for a predetermined amount of time sufficient to seal the web portions OW and OW' together. A stack counting counter is also incremented. The stack counter and its operation are similar to the previously discussed tag counter and its operation.

Once the stack counter has been incremented, a determination is made as to whether the current stack is the last stack to be produced before the banding web is fully severed. If the present stack is not the last stack, the direction of rotation of the shaft of the motor 90 is reversed in order to retract the jaw 89 and the cutter 100 away from the web. The home position switch 99S1 is monitored and as long as the jaw 89 is not in the home position, the motor 90 continues to operate in the reverse direction. When the jaw 89 reaches its home position, as indicated by an output from the switch 99S1, the motor 90 is stopped and the device is conditioned to monitor the sensing switch 77 for the next tag. Once the next tag, i.e., the first tag in the next stack is sensed, the process is repeated until the last stack is produced.

If the current stack is the last stack to be banded before the web is cut, the motor 90 is further advanced to bring the knife 100 through the web to thereby completely sever the web. To accomplish the severing action, the motor 90 may simply be operated for the predetermined amount of time sufficient to permit the motor to advance the knife 100 completely through the web, or a cut position sensor (not shown) may be utilized to sense when the knife 100 or the vane 99' are in the cut position.

After the jaw 89 and the knife 100 have been advanced to the cut position, the motor 90 is reversed and the home position switch 99S1 is again monitored. As long as the jaw 89 is not in the home position, the motor 90 continues to run in the reverse direction until the jaw 89 reach the home position, at which point the various counters are reset and the operation of the banding device is stopped to permit the operator to remove the banded stack S from the chute 22. The device is not ready to produce another set of tags whenever another start command is received. If desired, the device can be made to run continuously by automatically issuing a start command each time the home position of the jaw 89 is sensed after the last stack has been produced. Also, if desired, new data defining the number of tags per stack and stacks per band may be entered before the start command is issued.

Other embodiments and modifications of the invention will suggest themselves to those skilled in the art, and all such of these as come within the spirit of this invention are included within its scope as best defined by the appended claims.

We claim:

1. Apparatus for banding tags, comprising: a conveyor including an endless conveyor belt for supporting and frictionally engaging tags in spaced apart relationship along the belt and means for continuously moving the belt, means for stopping one tag at a time, means for lifting and transferring only the stopped tag directly from the moving belt to a stacking position where tags are accumulated in a stack, means for operating the lifting and transferring means before the next successive tag arrives at the stop member, means for stripping the stopped tag from the tag stopping means at the stacking position, means effective when a selected number of tags have been stacked for banding the tags, and means for controlling the stopping means, the operating means and the banding means.

2. Apparatus as defined in claim 1, wherein the conveyor includes a spaced pair of belts, wherein the stopping means includes a movable stop member disposed between the belts and has a notch aligned with the upper surface of the belts.

3. Apparatus as defined in claim 1, wherein the lifting and transferring means includes a pair of transferring members outboard of the belts.

4. Apparatus as defined in claim 2, wherein the lifting and transferring means includes a pair of transferring members outboard of the belts.

5. Apparatus as defined in claim 1, wherein the stopping means includes a stop member, wherein the lifting and transferring means includes a transferring member, and means for mounting the stop member and the transferring member for relative movement.

6. Apparatus as defined in claim 5, including means for mounting the stop member and the transferring member on separate axes.

7. Apparatus as defined in claim 5, wherein the transferring membet includes means for moving the stop member.

8. Apparatus for banding tags as defined in claim 1, wherein the means for stopping one tag at a time includes a pivotally mounted stop member, and wherein the lifting and transferring means includes a pivotally mounted transferring member cooperable with the stop member before the next tag arrives at the stop position.

9. Apparatus for banding tags at a stacking position, comprising: a continuously moving conveyor for conveying tags in spaced apart relationship along a path and means for continuously driving the conveyor, means adjacent the conveyor for stopping one tag at a time at a stop position while the conveyor continues to move, the stopping means including a stop member movable between a tag stopping position and an ineffective position, means for thereafter transferring the tag at a stop position directly from the moving conveyor to the stacking position where tags are accumulated in a stack, wherein the transferring means includes a transferring member movable between initial and transferred positions, means for stripping a tap from the stop member at the stacking position as the stop member moves into its ineffective position, means for moving the transferring member from its initial position to its transferred position and for moving the stop member from its stop position to its ineffective position and for thereafter returning the transferring member to its initial position and the stop member to its stop position, and means for securing a band around a completed stack when the transferring member has moved away from its transferred position.

10. Apparatus for banding tags at a stacking position, comprising: means for conveying tags in spaced apart relationship along a path, means for stopping one tal at a time at a stop position, the stopping means including a movable mounted stop member movable between a tag stopping position and an ineffective position, means for transferring the leading tag at the stop position to the stacking position where tags are accumulated in a stack, wherein the transferring means including a transferring member movable between an initial position and a transferred position, means for mounting the stop member and the transferring member for relative movement with respect to each other, means for stripping a tag from the stop member at the stacking position as the stop member moves to its ineffective position, and means for moving the transferring member and the stop member.

11. Apparatus as defined in claim 10, including means on the transferring member for driving the stop member.

12. Apparatus as defined in claim 11, including means for providing lost-motion between the transferring member and the stop member so that the transferring member moves toward its transferred position before the stop member moves toward its ineffective position.

13. Apparatus as defined in claim 10, including means for pivotally mounting the stop member a first axis, means for pivotally mounting the transferring means on a second axis spaced from the first axis.

14. Apparatus as defined in claim 13, including means on the transferring member for driving the stop member.

15. Apparatus as defined in claim 14, including means for providing lost-motion between the transferring member and the stop member so that the transferring member moves toward its transferred position before the stop member moves toward its ineffective position.

* * * * *

UNITED STATES PATENT AND TRADEMARK OFFICE

CERTIFICATE OF CORRECTION

PATENT NO. : 4,735,034

DATED : April 5, 1988

INVENTOR(S) : Bruce E. Taylor et al

It is certified that error appears in the above-identified patent and that said Letters Patent is hereby corrected as shown below:

Column 1, line 33, "respect" should be --aspect--; line 35, "detachable" should be --detachably--; line 40, "printed" (second occurrence) has been misspelled. Column 4, line 18, after "along" --one-- has been omitted. Column 7, line 26, "not" should be --now--. Column 8, line 8, "member" has been misspelled; line 29, "tap" should be --tag--; line 42, "tal" should be --tag--; line 44, "movable" (first occurrence) should be --movably--; line 66, after "member" --and-- has been omitted.

Signed and Sealed this

Fifteenth Day of August, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,735,034

DATED : April 5, 1988

INVENTOR(S) : Bruce E. Taylor et al.

It is certified that error appears in the above-identified patent and that said Letters Patent is hereby corrected as shown below:

Claim 1, Column 7, line 50, "stop member" should read -- stopping means --.

Signed and Sealed this

Fourteenth Day of November, 1989

*Attest:*

JEFFREY M. SAMUELS

*Attesting Officer* *Acting Commissioner of Patents and Trademarks*